United States Patent [19]

Dürrschnabel et al.

[11] Patent Number: 4,601,879

[45] Date of Patent: Jul. 22, 1986

[54] COPPER-NICKEL-TIN-TITANIUM-ALLOY AND A METHOD FOR ITS MANUFACTURE

[75] Inventors: Wolfgang Dürrschnabel, Bellenberg; Heinrich Stüer, Vöhringen; Jörg Steeb, Tiefenbach; Franz J. Puckert, Illerrieden, all of Fed. Rep. of Germany

[73] Assignee: Wieland-Werke AG, Ulm, Fed. Rep. of Germany

[21] Appl. No.: 737,976

[22] Filed: May 24, 1985

[30] Foreign Application Priority Data

Jun. 7, 1984 [DE] Fed. Rep. of Germany ..... 3421198
Sep. 1, 1984 [DE] Fed. Rep. of Germany ..... 3432226

[51] Int. Cl.[4] ..... C22F 1/08

[52] U.S. Cl. ..... 420/473; 420/488; 420/492; 148/412; 148/414; 148/11.5 C; 148/12.7 C; 148/160; 428/620

[58] Field of Search ..... 420/473, 488, 492; 148/412, 414, 11.5 C, 12.7 C, 160; 428/620

[56] References Cited

U.S. PATENT DOCUMENTS 3,421,888 1/1969 Saarivirta ..... 420/488
4,046,596 9/1977 Metcalfe ..... 148/2
4,337,089 6/1982 Arita et al. ..... 148/12.7 C
4,366,117 12/1982 Tsuji ..... 420/481

FOREIGN PATENT DOCUMENTS 1458340 10/1970 Fed. Rep. of Germany ..... 148/160
15217 2/1978 Japan ..... 420/492

*Primary Examiner*—Veronica O'Keefe
*Attorney, Agent, or Firm*—Flynn, Thiel, Boutell & Tanis

[57] ABSTRACT

A copper-nickel-tin-titanium-alloy suitable for use as a base material for semiconductors includes, by weight, 0.25 to 3.0% nickel, 0.25 to 3.0% tin, and 0.12 to 1.5% titanium, the remainder being copper and common impurities. An alternative form of the inventive alloy includes, by weight, 0.25 to 3.0% nickel, 0.25 to 3.0% tin, 0.12 to 1.5% titanium, and 0.05 to 0.45% chrome, the remainder being copper and common impurities. A method for making these alloys includes the steps of homogenizing the alloy at temperatures of 850° to 950° C. between 1 and 24 hours, hot-rolling the alloy at temperatures of 600° to 800° C. in one or more passes, and cooling the alloy to room temperature with a cooling speed of between 10° C. per minute and 2000° C. per minute.

21 Claims, 5 Drawing Figures

COPPER-NICKEL-TIN-TITANIUM-ALLOY AND A METHOD FOR ITS MANUFACTURE

FIELD OF THE INVENTION

This invention relates to a copper-nickel-tin-titanium-alloy, and to a method for its manufacture and use.

BACKGROUND OF THE INVENTION

There exists a great need for copper alloys for use for electrical purposes. These alloys are, among other things, needed as base materials for semiconductors, for example for transistors or integrated circuits. Base materials for semiconductors should have a particular combination of characterisics:

A. The mechanical strength must be sufficiently high so that a shape stability of the base is assured during the manufacture and also during the equipping with electronic elements. The need for strength increases mainly when the number of small connecting legs is high, because their regular alignment is of crucial importance for the automatic manufacture and equipping with elements.

B. The material must resist softening, so that the manufacturing steps needed during the semiconductor production, which steps are carried out at a higher temperature, do not lead to a loss of hardness and shape stability.

A measure for the softening resistance is the so-called half-hardness temperature $T_H$ which, according to FIG. 1, is obtained from the softening curve (Vickers hardness HV as a function of the annealing temperature T). The half-hardness temperature $T_H$ is thereby associated with the value $$HV_{min} + \frac{(HV_{max} - HV_{min})}{2}.$$

A thermal stress occurs substantially during the fastening of the semiconductor part on the base, when the adhesive is hardened or a euctectic reaction is caused between the silicon element and a gold coating of the base. Furthermore, higher temperatures occur during the connection of the semiconductor part with the small connecting legs using so-called bond wires, and during pressing of the complete building element into plastic. Temperatures of up to 400° C. can occur for long periods of time during these manufacturing steps. Therefore, no noticeable softening may be found in semiconductor materials below 350° to 400° C. As a rule, a hardness reduction of at most 10% of the initial hardness is permitted.

C. The electrical and thermal conductivity should be as high as possible, so that the power loss which is created on the silicon semiconductor during operation can be discharged in the form of heat and thus a self-destruction of the semiconductor is prevented. In order to assure the necessary degree of heat conduction, the electrical conductivity should lie, as much as possible, above 40% IACS (where 100% IACS corresponds to 58.00 m/Ohm.mm$^2$).

D. Homogenous materials are increasingly required, mainly for nonpurified semiconductor bases. This means materials having structures which do not contain any separations or inclusions, so that a satisfactory bond wire connection is assured. This avoids the uncertainty that the bond wire may hit such nonhomogeneities, which would cause the adhesion to worsen and the contact resistance to change. In order to increase the manufacturing and functional quality, homogeneous materials are being increasingly demanded for the field of application of semiconductor bases.

To date in the mentioned application, copper-iron-alloys, for example CDA 194, CDA 195 and other low-alloyed Cu-materials, for example CuNilSnlCrTi, have been utilized extensively. These materials have a sufficient hardness and good electrical conductivity. However, the structures of these materials contain clearly visible, and as a rule rectilinear, separations which can interfere during bonding. Bond wires which are completely or partially applied to these nonhomogeneties cannot meet the required electrical functionality or the required reliability, since the contact resistance is changed and the adhesive strength is worsened. Low-alloyed materials such as CuZn0.15, CuSn0.12 and CuFe0.1 are homogeneous and do not have the above-mentioned disadvantageous structural nonhomogeneities, but do have a strength which is too low for many fields of application.

SUMMARY OF THE INVENTION

Therefore, a basic purpose of the invention is to provide a copper alloy which, aside from a sufficient softening resistance, has an electrical conductivity above 40% IACS. A further purpose is providing an alloy having a strength which, in spite of visible separations, is sufficiently high, or in other words having a structure which, to the necessary degree, is free of nonhomogeneities, namely separations or inclusions.

These purposes are attained according to one form of the invention by providing a copper-nickel-tin-titanium alloy which is made of 0.25 to 3.0% nickel by weight,
0.25 to 3.0% tin by weight, and
0.12 to 1.5% titanium by weight,
The remainder being copper and common impurities.

The inventive addition of nickel, tin and titanium results in the formation of a nickel, tin, titanium-containing phase, the solubility of which in the matrix is sufficiently low so that the electrical conductivity lies within the given limits of 40 and 60% IACS. The phase separates in an extremely fine form.

Based on the nickel, tin, titanium-containing phase, the half-hardness temperature $T_H$ lies, for a thermal continuous stress of 1 hour, above 500° C.

The existence of the nickel, tin, titanium-containing phase separation is known from the copper, nickel, tin, titanium, chrome-containing alloy disclosed in German Pat. No. 29 48 916, but it was surprisingly found that, for a chrome-free alloy, the structure is substantially homogeneous. The nickel, titanium and tin-containing phase parts are smaller than 500 Å and thus do not interfere with its use as a semiconductor base in the aforementioned sense. It is at the same time surprising that the mechanical characteristics change only slightly.

In many applications, semiconductor bases receive metallic coats, and a further purpose of the invention is to provide an alloy composition which maintains the favorable characteristics of the inventive alloy just described, including suitability for direct bonding, and permits an error-free surface refinement of the base material.

This further purpose is attained according to the invention by including in the inventive alloy already described a small chrome additive of 0.05 to 0.45% by weight, and preferably 0.1 to 0.3% by weight.

Separations in the structure do occur as a result of the chrome additive but, due to their fine distribution, do not interfere with the direct bonding and do create favorable conditions for the galvanic treatment. Furthermore, the chrome-containing alloy shows a surprisingly good oxidation stability, since due to the fine distribution at relatively low temperatures a relative dense oxide layer is formed and stops further oxidation.

A CuNiSnTi-alloy with a chrome additive of 0.5 to 1.0% is indeed known from German Pat. No. 2 948 916, but the German patent does not suggest the small chrome additive to the CuNiSnTi-alloy according to the invention, because the German patent in particular does not deal with the question of oxidation stability.

To achieve the favorable combination of characteristics, both inventive alloys are preferably manufactured according to a method in which the alloy is cast, is then homogenized between 1 and 24 hours, preferably at temperatures of 850° to 950° C., is hot-rolled at temperatures of 600° to 800° C. in one or more passes, and is cooled to room temperature with a cooling speed of between 10° C. per minute and 2000° C. per minute.

It is advisable to carry out the hot-rolling at 650° to 750° C., and the cooling with a cooling speed of between 50° C. per minute and 1000° C. per minute. According to a preferred form of the method, cold-rolling is done after the cooling with a deformation degree of up to 95% in one or more passes. The alloy is, between the cold-rolling passes, preferably annealed up to a maximum of 10 hours to achieve, according to the invention, a uniform dispersion of the separation phase.

To achieve the desired characteristics, annealing as a band in a bell-type annealing furnace at temperatures of 350° to 500° C., or continuous annealing in a continuous annealing furnace at temperatures of 450° to 600° C., is advisable.

The last cold-rolling pass is preferably followed by a tempering treatment at the aforementioned temperatures.

The inventive alloy is used in an advantageous manner as a base material for semiconductors, in particular for transistors or integrated circuits.

DETAILED DESCRIPTION

The manufacture of the inventive alloy can occur as for common naturally hard alloys, since the NiSnTi-containing phase is separated without the quenching which is usually necessary when separation-hardening alloys in a manner in which the electrical conductivity is increased to an optimum and the softening is prevented.

The inventive copper-nickel-tin-titanium-alloys can be cast in the usual manner. To achieve a favorable characteristic combination, the alloy is, after the casting, preferably homogenized at temperatures of 850° to 950° C. between 1 and 24 hours, hot-rolled at temperatures of 600° to 800° C. in one or more passes, and cooled to room temperature with a cooling speed of between 10° C. per minute and 2000° C. per minute.

It is advisable to carry out the hot-rolling at 650° to 750° C., and the cooling with a cooling speed of between 50° C. per minute and 1000° C. per minute. According to a preferred form of the inventive method, cold-rolling takes place after the cooling with a deformation degree of up to 95% in one or more passes. The alloy can be annealed up to a maximum of 10 hours between the cold-rolling passes to achieve an inventive, uniform dispersion of the separating phase.

For maximum electrical conductivity, annealing as a band in a bell-type annealing furnace at temperatures of 350° to 500° C. is advisable, and for maximum strength annealing is to take place continuously in a continuous annealing furnace at temperatures of 450° to 600° C.

The last cold-rolling pass is preferably followed by a tempering treatment at the aforementioned temperatures.

The copper-nickel-tin-titanium-alloy can inventively be used as a base material for semiconductors, in particular for transistors or integrated circuits.

Figure 1:
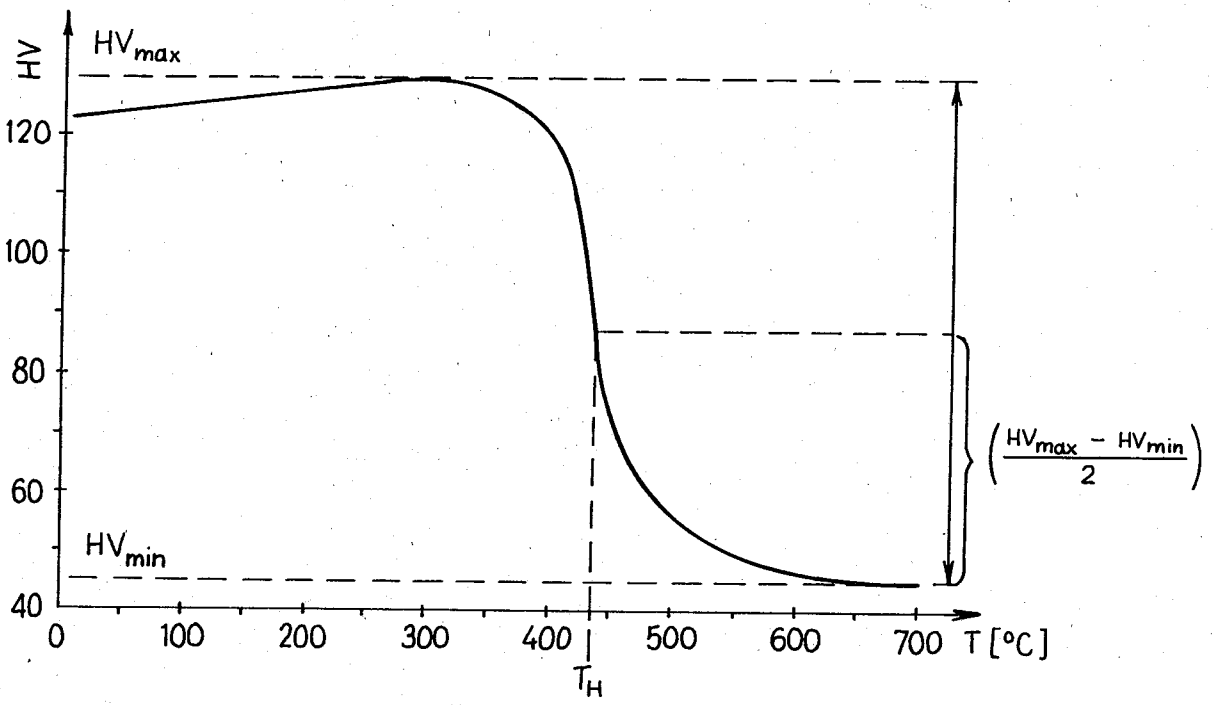
FIG. 1 is a graph showing a softening curve, which is the Vickers hardness HV as a function of the annealing temperature T.

To explain the term softening and the term half-hardness temperature $T_H$, FIG. 1 shows a softening curve. The Vickers hardness HV is shown as a function of the annealing temperature T. After determining the hardness maximum $HV_{max}$ and the hardness minimum $HV_{min}$, the half-hardness temperature $T_H$ is associated with the value $$HV_{min} + \frac{(HV_{max} - HV_{min})}{2}.$$

The inventive alloy which does not include chrome will be discussed in greater detail in connection with the following example.

EXAMPLE 1

Table 1 illustrates the composition of an alloy according to the invention (No. 1) and a chrome-containing comparison alloy CuNilSnlCrTi (No. 2) which is known from German Pat. No. 2 948 916, data being given in percentage by weight.

TABLE 1

| | Composition of the samples | | | | |
|---|---|---|---|---|---|
| Sample | Sn | Ni | Ti | Cr | Cu |
| 1 | 1.09 | 0.98 | 0.54 | n.n. | remainder |
| 2 | 1.09 | 0.93 | 0.42 | 0.73 | remainder |

n.n. = not detectable

The alloys were manufactured in the following manner:

The electrolyte copper was melted together with cathode nickel and fine tin in an induction furnace at approximately 1200° C. under a charcoal layer. After complete dissolving of same, titanium was added in the form of a suitable key alloy copper-titanium. The key alloy contained 28% titanium in a pure form. After the dissolving thereof, the fluid solution was chilled in an iron mold with the dimensions 25×50×100 mm. The resulting blocks were homogenized for 1 hour at 900°

C. and thereafter hot-rolled at 750° C. to 1.87 mm. The cooling of the band occurred continuously in air. Bands with a 0.3 mm thickness were subsequently manufactured therefrom by cold-rolling, finish annealing at 1 h/470° C., and subsequent pickling in diluted $H_2SO_4$. The finish rolling was uniformly 60% for all samples. After the tempering at 1 h/500° C., the samples were examined with respect to their mechanical and physical characteristics and the homogeneity of their structure. The values for strength, spring bending limit and electrical conductivity are compiled in Table 2, and structural characteristics of representative samples are explained in association with FIGS. 2 and 3.

TABLE 2

| Strength, spring bending limit and electrical conductivity of 0.3 mm band samples in a tempered condition | | | | | | | |
|---|---|---|---|---|---|---|---|
| | Yield Strength Rp 0.2 | Tensile Strength Rm | Elongation A10 | Vickers hardness | Spring bending limit | Electrical conductivity | |
| Sample | (N/mm²) | (N/mm²) | (%) | HV1 | (N/mm²) | (m/Ω · mm²) | % IACS |
| 1 | 603 | 640 | 10 | 200 | 543 | 26.0 | 44.8 |
| 2 | 600 | 629 | 10 | 205 | 551 | 29.9 | 51.5 |

The listed values in Table 2 show only a slight reduction in electrical conductivity of the inventive copper alloy as compared with the chrome-containing alloy.

Figure 2:
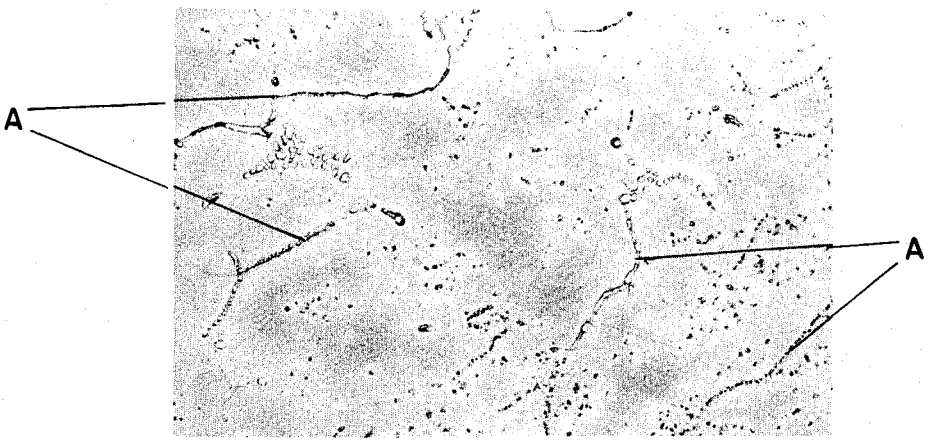
FIG. 2 is a micrograph of a 500 to 1 enlargement of a cast structure of a conventional alloy.
Figure 3:
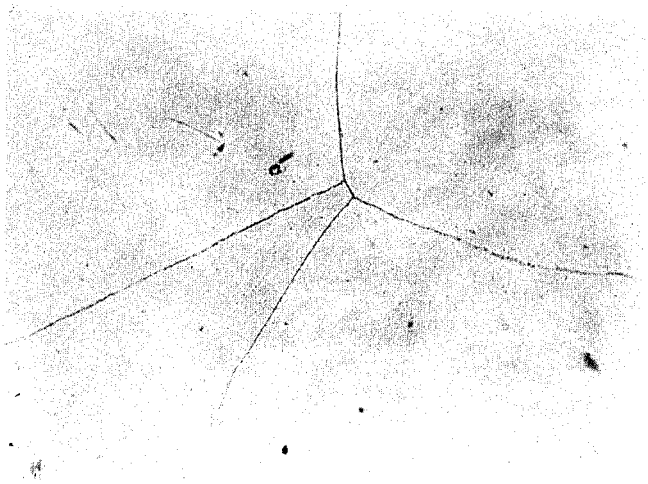
FIG. 3 is a micrograph of a 500 to 1 enlargement of a cast structure of an alloy according to the invention which is free of chrome.

Mainly, however, it can be recognized during a comparison of the microsection surfaces of the homogenized cast structures of both alloys that the structure of the inventive alloy is practically free of rectilinear separation lines. In connection with this, FIG. 2 illustrates in an enlargement of 500:1 a micrograph of the cast structure of the comparison alloy CuNilSnlCrTi. The separation lines are identified with reference characters A. FIG. 3 illustrates in the same enlargement a micrograph of the cast structure of the inventive alloy, which is free of such separations.

The inventive alloy which includes a small chrome additive will be discussed in greater detail in connection with the following example:

EXAMPLE 2

Table 3 illustrates the composition of the chrome-free inventive alloy CuNilSnlTi (No. 1), which will serve as a comparison alloy, two versions of the inventive alloys (Nos. 3 and 4) with a low chrome content, and a, chrome-containing comparison alloy CuNilSnlTiCr (No. 5), which is known from German Pat. No. 2 948 916. Data is given in percentage by weight.

TABLE 3

| | Composition of the Samples | | | | |
|---|---|---|---|---|---|
| Sample | Sn | Ni | Ti | Cr | Cu |
| 1 | 1.09 | 0.98 | 0.54 | n.n. | remainder |
| 3 | 1.07 | 0.94 | 0.49 | 0.25 | " |
| 4 | 1.08 | 0.94 | 0.47 | 0.43 | " |

TABLE 3-continued

| | Composition of the Samples | | | | |
|---|---|---|---|---|---|
| Sample | Sn | Ni | Ti | Cr | Cu |
| 5 | 1.09 | 0.93 | 0.42 | 0.65 | " |

n.n. = not detectable

The alloys were manufactured by the same method described in Example 1. After tempering at 1 h/400° C., (alloy 1 at 1 h/500° C.), the samples were examined with respect to their mechanical and electrical characteristics, homogeneity of structure, and oxidation stability.

The values for solidity, spring bending limit and electricl conductivity are compiled in Table 4.

TABLE 4

| Mechanical and electrical characteristics of 0.3 mm band samples in a tempered condition | | | | | | | |
|---|---|---|---|---|---|---|---|
| | Yield strength Rp 0.2 | Tensile strength Rm | Elongation A10 | Vickers hardness | Spring bending limit δbE | Electrical conductivity | |
| Sample | (N/mm²) | (N/mm²) | (%) | HV1 | (N/mm²) | (m/Ωmm²) | % IACS |
| 1 | 603 | 640 | 10 | 200 | 543 | 26.0 | 44.8 |
| 3 | 663 | 696 | 13 | 229 | 610 | 29.8 | 51.4 |
| 4 | 661 | 697 | 11 | 238 | 624 | 28.2 | 48.6 |
| 5 | 679 | 720 | 11 | 241 | 581 | 28.1 | 48.5 |

While the values for the yield strength, tensile strength and hardness increase with an increasing chrome content, it is surprising that a maximum of the spring bending limit occurs in the inventive alloys 3 and 4.

Figure 4:
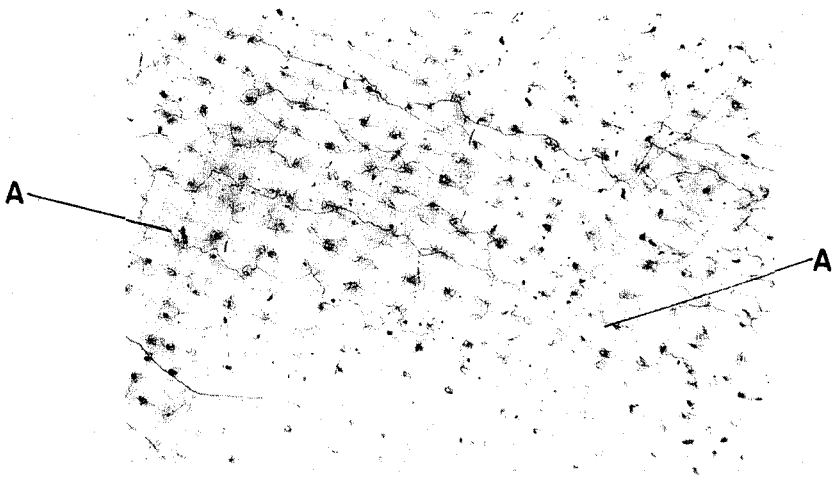
FIG. 4 is a micrograph of a 200 to 1 enlargement of a cast structure of an alloy according to the invention which includes a small chrome additive.

FIG. 4 illustrates in an enlargement of 200:1 a micrograph of the homogenized cast structure of the inventive alloy No. 3. One can clearly recognize the fine distribution of the separations which are identified with A, and which interfere neither with direct bonding nor galvanic treatment.

Figure 5:
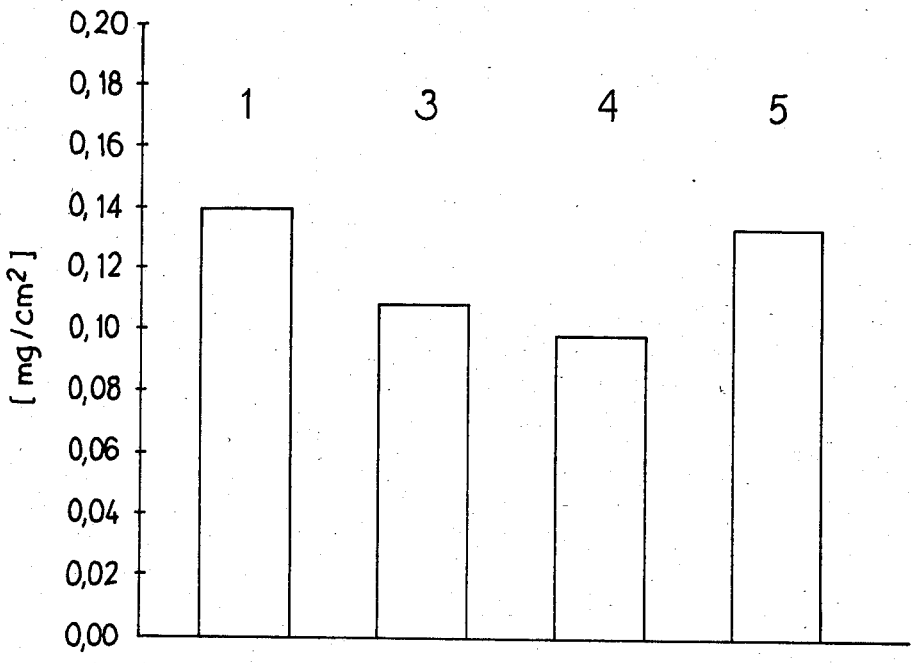
FIG. 5 is a graph showing weight increases for several different alloys.

The oxidation stability of the alloys 1 and 3 to 5 was examined by annealing in air in the temperature range of 200° to 500° C. The samples were thereby each held for 30 minutes at 200° C., 250° C., 300° C., etc. FIG. 5 shows for this the entire weight increase of the samples. According to FIG. 2, the alloys 3 and 4 with the inventive chrome content show the least weight increase.

Although particular preferred embodiments of the invention have been disclosed in detail for illustrative purposes, it will be recognized that variations are possible without leaving the scope of the present invention.

The embodiments of the invention in which an exclusive property or privilege is claimed are defined as follows:

1. A copper-nickel-tin-titanium-alloy, consisting essentially of:

0.3 to 2.8% nickel by weight, 0.25 to 3.0% tin by weight, 0.25 to 0.75% titanium by weight, the remainder being copper and common impurities.

2. The alloy according to claim 1, wherein said alloy contains 0.5 to 1.5% nickel by weight.

3. The alloy according to claim 1, wherein said alloy contains 0.9 to 1.1% nickel by weight.

4. The alloy according to claim 1, wherein said alloy contains 0.3 to 2.8% tin by weight.

5. The alloy according to claim 4, wherein said alloy contains 0.5 to 1.5% tin by weight.

6. The alloy according to claim 4, wherein said alloy contains 0.9 to 1.1% tin by weight.

7. The alloy according to claim 1. wherein said alloy contains 0.45 to 0.55% titanium by weight.

8. The alloy according to claim 1, wherein the constituents nickel, tin and titanium exist in said alloy in the relationship A:B:C, where A=1.8 to 2.2; B=1.8 to 2.2 and C=0.9 to 1.1.

9. The alloy according to claim 1, wherein the constituents nickel, tin and titanium exist in said alloy in the relationship 2:2:1.

10. A copper-nickel-tin-titanium-alloy, consisting essentially of:
0.3 to 2.8% nickel by weight,
0.25 to 3.0% tin by weight,
0.25 to 0.75% titanium by weight,
0.05 to 0.45% chrome by weight,
the remainder being copper and common impurities.

11. The alloy according to claim 10, wherein said alloy contains 0.1 to 0.3% chrome by weight.

12. The alloy according to claim 10, wherein said alloy contains 0.5 to 1.5% nickel by weight.

13. The alloy according to claim 10, wherein said alloy contains 0.9 to 1.1% nickel by weight.

14. The alloy according to claim 10, wherein said alloy contains 0.3 to 2.8% tin by weight.

15. The alloy according to claim 10, wherein said alloy contains 0.5 to 1.5% tin by weight.

16. The alloy according to claim 10, wherein said alloy contains 0.9 to 1.1% tin by weight.

17. The alloy according to claim 10, wherein said alloy contains 0.45 to 0.55% titanium by weight.

18. The alloy according to claim 10, wherein the constituents nickel, tin and titanium exist in said alloy in the relationship A:B:C, where A=1.8 to 2.2; B=1.8 to 2.2 and C=0.9 to 1.1.

19. The alloy according to claim 10, wherein the constituents nickel, tin and titanium exist in said alloy in the relationship 2:2:1.

20. A semiconductor base material which is a copper-nickel-tin-titanium-alloy consisting essentially of:
0.3 to 2.8% nickel by weight,
0.25 to 3.0% tin by weight,
0.25 to 0.75% titanium by weight,
the remainder being copper and common impurites.

21. A semiconductor base material which is a copper-nickel-tin-titanium-alloy consisting essentially of:
0.3 to 2.8% nickel by weight,
0.25 to 3.0% tin by weight,
0.25 to 0.75% titanium by weight,
0.05 to 0.45% chrome by weight,
the remainder being copper and common impurities.

* * * * *